United States Patent [19]

Kyte

[11] 4,294,269

[45] Oct. 13, 1981

[54] COMPACT TOOTHBRUSH KIT

[76] Inventor: Albert D. Kyte, P.O. Box 2523, Pensacola, Fla. 32503

[21] Appl. No.: 764,354

[22] Filed: Jan. 31, 1977

[51] Int. Cl.[3] ..... A45D 44/18

[52] U.S. Cl. ..... 132/84 B

[58] Field of Search ..... 132/84; 206/227, 229, 206/63.5

[56] References Cited

U.S. PATENT DOCUMENTS 1,464,250 8/1923 Lieberthal ..... 132/84 R 1,847,495 3/1932 Priest ..... 132/84 A

*Primary Examiner*—G. E. McNeill

*Attorney, Agent, or Firm*—Howard I. Podell

[57] ABSTRACT

An assembly of a toothbrush detachably mounted to a hollow cylindrical housing in which dentrifice tube may be stored; with a hollow cap threaded to the housing in which a reel of dental floss is stored. The assembly, in disassembled condition, is stored in an enclosure. A coupling formed of a sleeve fitted with an internal thread serves to join the threaded neck of a dentrifice tube with the threaded neck of a supply tube.

3 Claims, 9 Drawing Figures

III
VI
10
70

FIG. 7
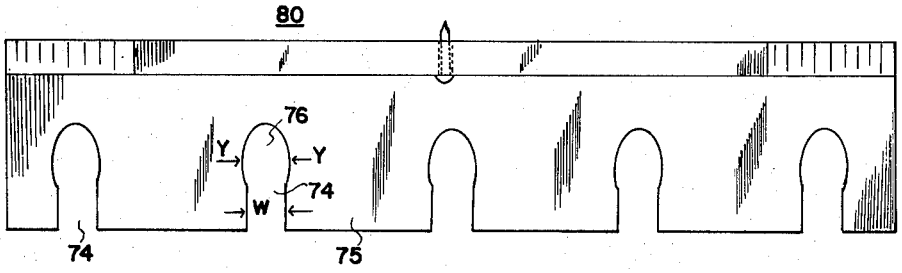
FIG. 8
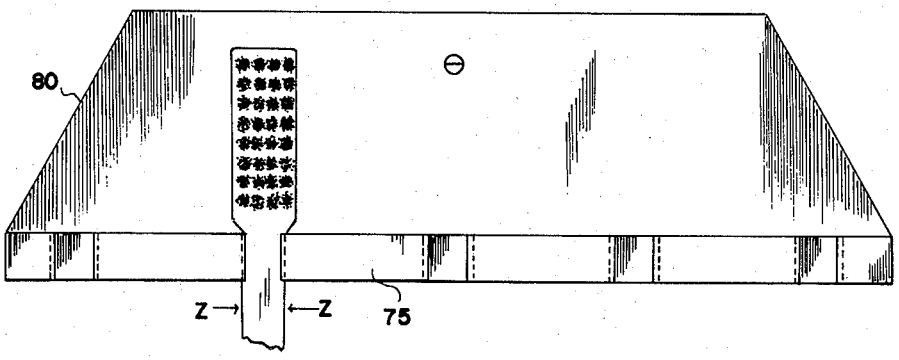
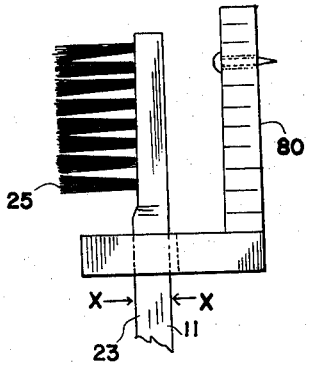
FIG. 9

COMPACT TOOTHBRUSH KIT

SUMMARY OF THE INVENTION

My invention is an assembly of a toothbrush detachably mounted to a hollow cylindrical housing in which dentifrice tube may be stored; with a hollow cap threaded to the housing in which a reel of dental floss is stored. The assembly, in disassembled condition, is stored in an enclosure. A coupling formed of a sleeve fitted with an internal thread serves to join the threaded neck of a dentifrice tube with the threaded neck of a supply tube.

My invention is suitable for both civilian and military use and is particularly suitable for portable use by military troops in training or under combat conditions.

BRIEF DESCRIPTION OF THE DRAWINGS

The objects and features of the invention may be understood with reference to the following detailed description of an illustrative embodiment of the invention, taken together with the accompanying drawings in which:

FIG. 7 is a plan view of a wall mounting bracket;

FIG. 8 is a front view of the wall mounting bracket; and

FIG. 9 is a detail side view of the wall mounting bracket.

DESCRIPTION OF THE PREFERRED EMBODIMENT

Figures 1, 2, 3, 4, 5, 6:
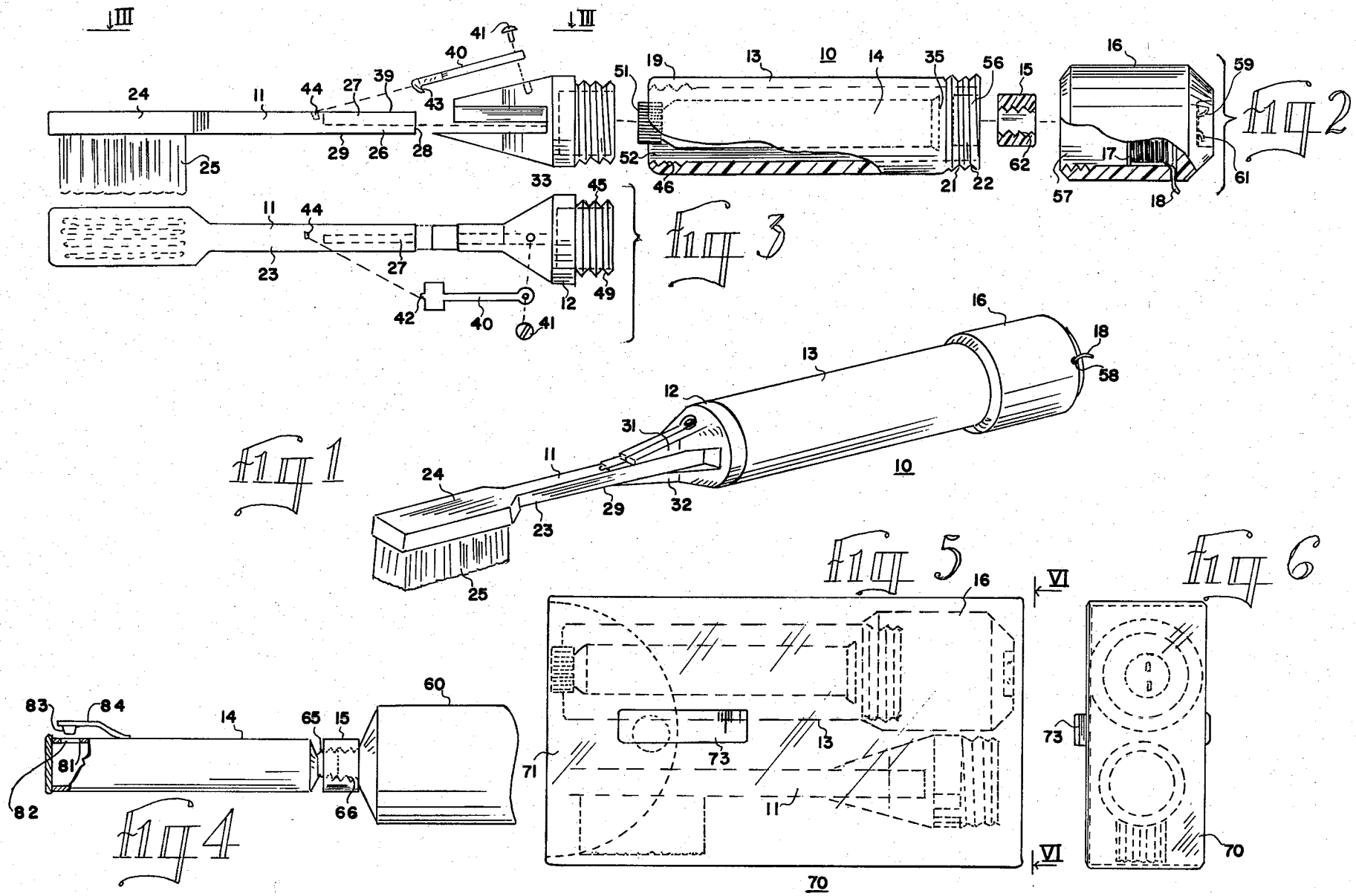
FIG. 1 is a perspective view of the toothbrush assembly.
FIG. 2 is a perspective exploded view of the toothbrush assembly.
FIG. 3 is a plan exploded view of the toothbrush mount sub-assembly, taken along line III—III of FIG. 1.
FIG. 4 is a detail view of the dentifrice tube coupled to a supply tube for refilling.
FIG. 5 is a plan view of the kit housing.
FIG. 6 is an end view of the kit housing, taken along FIG. VI—VI of FIG. 5.

Turning now descriptively to the drawings, in which similar reference characters denote similar elements throughout the several views, FIGS. 1-3 illustrate the toothbrush assembly 10 comprising a toothbrush unit 11 detachably fastened to a mount cap 12 that is threaded to the front end 19 of cylindrical housing 13 that encloses a removable flexible tubular container 14 of dentifrice, and a coupler sleeve 15, with a hollow end cap 16 enclosing a reel 17 of dental floss 18 threaded to external male threads 21 about the rear end 22 of housing 13.

Toothbrush unit 11 is formed of a shank 23 fitted at a front end 24 with bristles 25, with shank 23 formed as a strip of rectangular cross-section. The rear end section 26 of shank 23 is shaped of rectangular cross-section and formed with an open groove 27 open to the shank top surface 39 and extending in to the rear end wall 28 of shank 23.

Mount cap 12 is formed with a pair of spaced jaw sections 31, 32 extending axially from a circular plug section 33 with jaw section 31 shaped to fit into groove 27 of toothbrush shank 23 and jaw 32 shaped to bear against the back surface 29 of shank 23 which is opposed to the top surface 39 of shank 23.

A flexible finger 40 is fastened to the exterior of plug section 23 by a screw 41 with the free end of finger 40 shaped as a hook 43 to latch into a hole 44 extending from the top surface 39 of shank 23 to latch the toothbrush unit 11 detachably to mount cap 12. Mount cap 12 is formed with a male thread 45 that matingly engages female thread 46 at the open end section 19 of housing 13, with female thread 46 formed on a sleeve section 49 that encloses the cap 51 of a dentifrice tube 14 projecting beyond the end section 19 of housing 13.

Housing 13 is formed with cylindrical recess 52 open to front end 19 and enclosed by an end wall 53, with rear end 22 of housing 13 formed with an open recess 56 of a size to freely contain coupler 15.

End cap 16 is of tubular shape enclosing a chamber 57 of a size to house a reel 17 of dental floss 18, and fitted with a hole 58 through which a thread of the floss 18 may extend for use. A clip 59 fitted with a cutting edge is mounted in an exterior recess 61 of cap 16 for use in cutting a used length of floss.

Collar 15 is shaped as a sleeve formed with a continuous internal female thread 62 of a size to engage the threaded neck sections 65, 66 of the dentrifice tube 14 to a supply dentrifrice tube 60 respectively for purposes of refilling tube 14, as shown in FIG. 4.

The wall 81 of tube 14 is formed with a through vent hole 82 for venting tube 14, when refilling, with hole 82 plugged by a detent 83 on a strap 84 that is externally fixed to tube wall 81.

As shown in FIGS. 5-6, the disassembled assembly 10 may be stored in a container 70 fitted with a cover 71 that is detachably fastened by an exterior clip 72. Container 70 may be fitted with an exterior clip 73 for fastening to a wall bracket or in a pocket of a knapsack (not shown).

A bracket unit 80 may be included as part of a kit for fastening individual brush units 11 by their shanks 23 through U-shaped openings 74 in a flange 75 of the bracket unit 80. Openings 74 may be of a width W to fit about the narrow section X—X of shank 23 with openings 74 leading to an oval-shaped internal recess 76 in flange 75 of a width Y of a size to fit about the wide section Z—Z of shank 23 so that shank section 23 may be inserted sidewise into opening 74 and rotated ninety degrees to be securely held in place in oval-shaped recess 76.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toothbrush assembly which may be disassembled to fit into a container, comprising a shank unit fitted at a first end with bristles and shaped at a second end to detachably engage a first cap, a tubular housing threadably attachable at a first end to said first cap and fitted with an internal chamber open at one end of the housing of a size to contain a tube of dentifrice, and a second cap threadably attachable to a second end of said housing, said second cap fitted with a chamber of a size to contain a reel of dental floss, said second cap formed with a through hole to permit a length of dental floss to extend through said second cap, in which a member formed with a projecting cutting edge section, for cutting of dental floss, is externally mounted to the assembled housing, said member and cutting edge section being located within the confines of an open external recess in said assembled housing.

2. The assembly, as recited in claim 1 in which the said member and cutting edge section is located within the confines of an external recess of the second cap.

3. A toothbrush assembly which may be disassembled to fit into a container, comprising a shank unit fitted at a first end with bristles and shaped at a second end to detachably engage an end section of a tubular housing fitted with an internal chamber open at a first end of the housing of a size to contain a tube of dentifrice, and a cap threadably attachable to said first end of said housing, said cap fitted with a chamber of a size to contain a reel of dental floss, said cap formed with a through hole to permit a length of dental floss to extend through said cap, together with a flexible tube of dentifrice enclosed in said housing and a reel of dental floss enclosed in said cap, in which the end section of said shank unit adjacent a second end of said shank unit is shaped as a non-round cross-section of a size to detachably engage in a shaped opening formed by a pair of spaced projecting members extending from a second end of said housing that is opposed to said first end of said housing, together with flexible latch means mounted externally on one of said projecting members that engages a blind opening extending from an open external surface of said shank unit.

* * * * *